US006148592A

United States Patent [19]

Schneider

[11] Patent Number: 6,148,592

[45] Date of Patent: Nov. 21, 2000

[54] DIRECT CONTACT REIN

[75] Inventor: Stanley K. Schneider, Gates Mills, Ohio

[73] Assignee: Schneiders Saddlery Co., Inc., Chagrin Falls, Ohio

[21] Appl. No.: 09/128,177

[22] Filed: Aug. 3, 1998

[51] Int. Cl.[7] ..... B68B 1/04

[52] U.S. Cl. ..... 54/36

[58] Field of Search ..... 54/16, 36

[56] References Cited

U.S. PATENT DOCUMENTS

| | | | |
|---|---|---|---|
| 297,795 | 4/1884 | Hazelton | 54/36 X |
| 320,139 | 6/1885 | Johnson | 54/36 |
| 392,789 | 11/1888 | Dickinson | 54/36 |
| 424,258 | 3/1890 | Belknap | 54/36 X |
| 4,745,733 | 5/1988 | Bork | 54/7 |
| 4,884,390 | 12/1989 | Benjak et al. | 54/7 |
| 4,941,312 | 7/1990 | Old, Sr. | 54/8 |
| 4,953,345 | 9/1990 | Boone | 54/13 X |
| 4,965,987 | 10/1990 | Bork | 54/7 |
| 5,001,892 | 3/1991 | Mezin et al. | 54/71 |
| 5,062,255 | 11/1991 | Myler et al. | 54/7 |
| 5,357,735 | 10/1994 | Fry | 54/9 |
| 5,528,884 | 6/1996 | Johnson | 54/8 |

OTHER PUBLICATIONS

Schneiders Saddlery Annual Catalog, 1997–98, pp. 22,37, 74,77–79,84,85,87,89,91, index.

*Primary Examiner*—Robert P. Swiatek
*Attorney, Agent, or Firm*—Jones, Day, Reavis & Pogue

[57] ABSTRACT

A braided romal rein having a bit end that is directly attachable to a bit, without the need for a separate connecting piece, provides direct contact between the bit in the animal's mouth and the rider's hands. The bit end of the rein comprises a rigid member that is integral with the rein and which has a connector portion that can be tightly connected to the end ring of the bit. Because the entire length of the rein, including the portion that connects to the bit, is a continuous construction, the former problems of loose joints at the rein end and the bit end are eliminated.

18 Claims, 12 Drawing Sheets

DIRECT CONTACT REIN

BACKGROUND OF THE INVENTION

The invention relates to reins for use with a bit for controlling the direction of a domestic riding animal, such as a horse, mule or donkey, when the animal is being ridden. In particular, the invention relates to a braided romal rein having an integral connector at the bit end for directly attaching the rein to a bit, thus providing direct contact between the bit in the animal's mouth and the rider's hands.

During a long period of history of horsemanship, various devices have been invented to assist the rider in controlling the animal and causing it to move in the desired direction. Refinement of the control devices has resulted in the now familiar tack arrangement illustrated in FIG. 1 of a bridle 1 comprised of straps which adjustably fit around the animal's head 2, a metal bit 3 including a mouthpiece 4 adapted to fit in the animal's mouth and extend over and atop its tongue, and a set of reins 5 which are conventionally attached to end rings 6 of the bit 3 at either side of the animal's mouth.

There are two basic styles of Western reins: split reins which are two separate reins, and the romal rein, schematically illustrated (not to scale) in FIG. 2, which is one continuous rein 7 forming a loop 8, and a third part (the romal) 9 which hangs from the loop 8 and is attached to it by a connector 10. Most conventional braided romal reins are made by hand braiding leather around a heavy nylon rope core that extends through the entire length of the continuous rein, including oval loops 11. The oval loops 11 extend from the bit end 12 of the rein and are formed by turning the ends of the covered (braided) core to the inside and securing them by tightly braiding a terminal "barrel" 18 around them. Various ornamentations may be added to the reins, such as the illustrated braided leather buttons 16, knots 17, and barrels 18, or, in many cases, more ornate silver ornamentations.

For over two hundred years, conventional braided romal reins have been made with the oval braided loops 11 at the bit end 12 and a pair of removable braided connectors 13 (FIG. 3) for connecting each of the braided loops 11 to an end ring 6 of the bit 3. This conventional rein/connector design has been problematic because the loose joints created between the braided connector and the end ring of the bit, and again between the braided connector and the oval loop of the rein, cause a loss of direct contact between the rider's hands and the bit in the animal's mouth.

For many years, riding and saddlery professionals have attempted to overcome this problem. For example, one reported solution has been to run a stiff wire from the rein, along the connector, to the bit, and to tape or wire the whole unit together. However, this type of connection has now been declared illegal by the International Arabian Horse Association and the American Horse Show Association. Recently, a leather connector 14 (FIG. 4) has been developed that attempts to more rigidly connect the bit ring 6 with the braided loop 11 at the bit end 12 of the rein by means of a chicago screw 15. However, this design still requires a separate "connector" piece between the bit ring and the loop at the end of the reins and does not provide tight connections at either the rein end or the bit end. This connector also is not very stiff because a lightweight piece of leather must be employed to be thin enough to fit through the end ring of the bit.

In view of the foregoing, there is still a need for a rein design, especially for braided romal reins, that effectively provides direct contact between the bit in the animal's mouth and the rider's hands. In particular, there is a need for eliminating the problem of loose connections between the rein and the bit that presently exist when using conventional braided romal reins.

SUMMARY OF THE INVENTION

The invention provides a braided romal rein having a bit end that is directly attachable to the bit, without the need for a separate connecting piece between the rein and the bit. In particular, the bit end of the rein comprises a rigid member that is integral with the rein and which has a connector portion that can be tightly connected to the end ring of the bit. As used in the context of the invention, the term "rigid" refers to a member that has a strength and stiffness that is approximately equivalent to the strength and stiffness of an 8 ounce (oz.) piece of leather normally used in strap goods, such as reins and bridles. As used herein, the term "ounce" when referring to the weight of various leather pieces means ounces per square foot.

Because the entire length of the rein of the invention, including the portion that connects to the bit, is a continuous construction, the former problem of a loose joint at the rein end is eliminated. The stiff connector portion of the rigid member also assures a tight connection between the rein and the bit, and eliminates the former problem of a loose joint at the bit end. Thus, the braided romal rein of the invention provides direct contact between the bit in the animal's mouth and the riders hands.

In a preferred embodiment, the rigid member at the bit end of the rein comprises at least three layers, i.e., two thin, lightweight outer layers, preferably of leather, and one or more inner reinforcing layers of material, such as plastic coated cotton webbing, vinyl coated nylon material, and the like. The reinforcing layer(s) is the major source of the strength and stiffness of the rigid member. The outer and inner layers are secured to each other for part or all of their length by sewing, glueing, binding, or other means of attachment known to those skilled in the art. For aesthetic purposes, the outer layers of the rigid member can be type- and/or color-matched to the leather used in the braided portion of the rein.

An important feature of the preferred embodiment of the rigid member is that the required strength and stiffness can be achieved by employing a reinforcing layer that is thin (e.g., 1/16 inch thickness or less), together with thin outer layers of leather, such as 4 oz. leather pieces that each have a thickness of 1/16 inch or less. Thus, the total thickness of the rigid member can be about 1/8 inch to about 3/16 inches. As will become apparent in the embodiments of the invention described below, the thinness of the rigid member is advantageous, not only because it allows the member to fit through the end ring of the bit, but also because the rigid member can be integrally secured with or to the braided portion of the rein within a flexible rein member (described below) in a manner that is not bulky. Thus, in the preferred embodiments of the invention, the flexible member typically has a diameter similar to that of the terminal braided barrel of a conventional braided romal rein.

In each of the embodiments of the braided romal rein of the invention, the length of the braided core of the rein is shortened compared with that of a conventional braided core, such that it does not form a conventional oval loop at the bit end of the rein. Rather, the bit end of the core of the invention rein is tightly secured within the flexible tubular interior of a flexible member of the rein. As used in the context of the invention, the terms "end of the core" and "core end" of the braided rein, are intended to encompass both a naked rope core end and a braided core end.

One end of the rigid member of the rein is also secured within the flexible tubular interior. As used in the context of the invention, the terms "flexible tubular interior" and "flexible member" refer to a construction in which a tubular interior containing both the core end and the rigid member end is formed by tightly enclosing and securing both ends with a flexible binding material. For example, such a construction could be formed by tightly binding a flexible cord (e.g., cotton, plastic or leather) around the core and rigid member ends or, more preferably, by tightly braiding a flexible cord (e.g., cotton, plastic, or thin, 1–2 oz. leather strands) around the ends. The flexible member thus comprises the construction including the flexible tubular interior and the outer flexible binding material ("outer wall") and the construction is considered "flexible" by virtue of the fact that it conforms to the shape of the enclosed ends. An example of a flexible member is a terminal braided barrel in a conventional braided romal rein.

In a preferred embodiment of the invention, the rigid member comprises at least two layers that enclose the end of the core of the rein in a sandwich configuration. The rigid member layers are stitched and/or glued or otherwise attached to the core, thus securing the rigid member directly to the core of the rein. Other embodiments of the positioning and securing of the core and rigid member within the flexible member are described herein below.

Regardless of the manner in which the core and rigid member ends are secured, the rigid member becomes integral with the length of braided rein, and the rein, including the rigid member, comprises a continuous construction.

The bit end of the rigid member extends externally from the flexible member and comprises a connector portion for connecting the rein to the end ring of the bit. In embodiments of the invention, the connector portion may have several configurations, described below, each of which is designed to ensure a tight connection between the rein and the bit and to prevent a loose "joint". In a preferred embodiment of the connector portion, the rigid member comprises at least two layers that are separated from each other at the connector end. For connecting to the end ring of the bit, the separated layers form a sandwich around the ring. The whole sandwich assembly is then secured by a bolt arrangement, such as a chicago screw, that passes through the layers and the end ring of the bit. More preferably, at least one of the separated layers further comprises the reinforcing layer that imparts strength and stiffness to the rigid member.

In other embodiments, the connector portion of the rigid member may be in the form of a strap that has a strap end for passing through the end ring of the bit to form a loop and which may then be fastened to the rigid member by a fastener, such as a snap fastener, a buckle, a chicago screw, or the like, or tied with a cord. In another embodiment, the connector portion of the rigid member may comprise a rigid snap end fastener that is integrally attached to and extends from the rigid member, for snapping onto the ring of the bit.

The invention provides other romal reins and split reins, described further below, that have bit ends that provide a tight connection between rein and bit.

DETAILED DESCRIPTION OF THE INVENTION

The invention provides reins that, unlike conventional braided romal reins, do not terminate in oval loops. Rather, the reins of the invention terminate in rigid connectors that are an integral part of the rein at the bit end, for directly connecting the reins to the end rings of the bit. The reins of the invention eliminate the need for an intervening connecting piece and, therefore, eliminate the problems associated with loose connecting joints in conventional romal rein/connector design. Although the reins are described herein with particular reference to braided romal reins, one skilled in the art will be sufficiently instructed by the embodiments of the invention to be able to apply the teachings to all types of romal reins and split reins, without undue experimentation.

Figure 1:
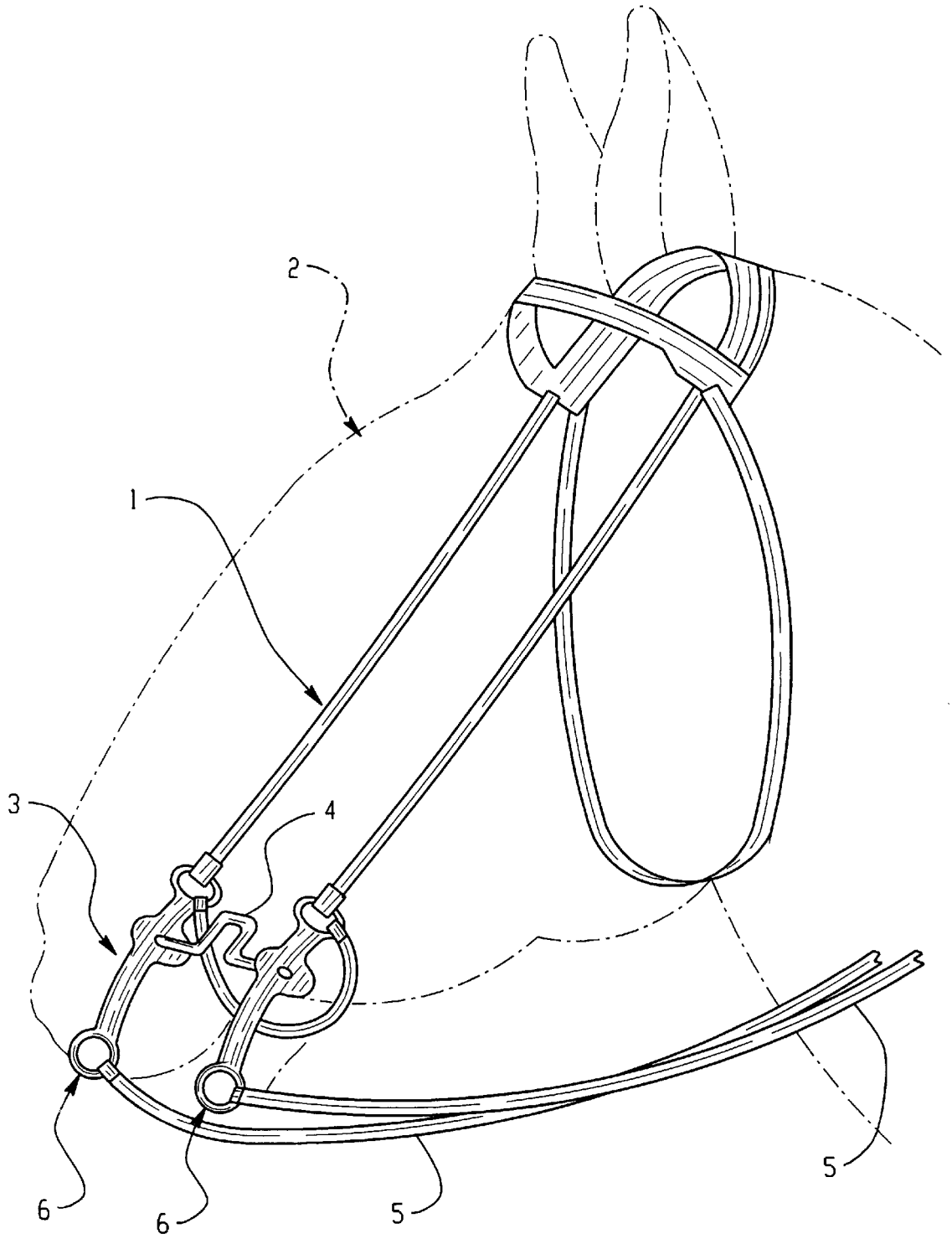
Fig. 1 (PRIOR ART)
FIG. 1 is a schematic illustration of a conventional tack arrangement for use when riding a horse.
Figure 2:
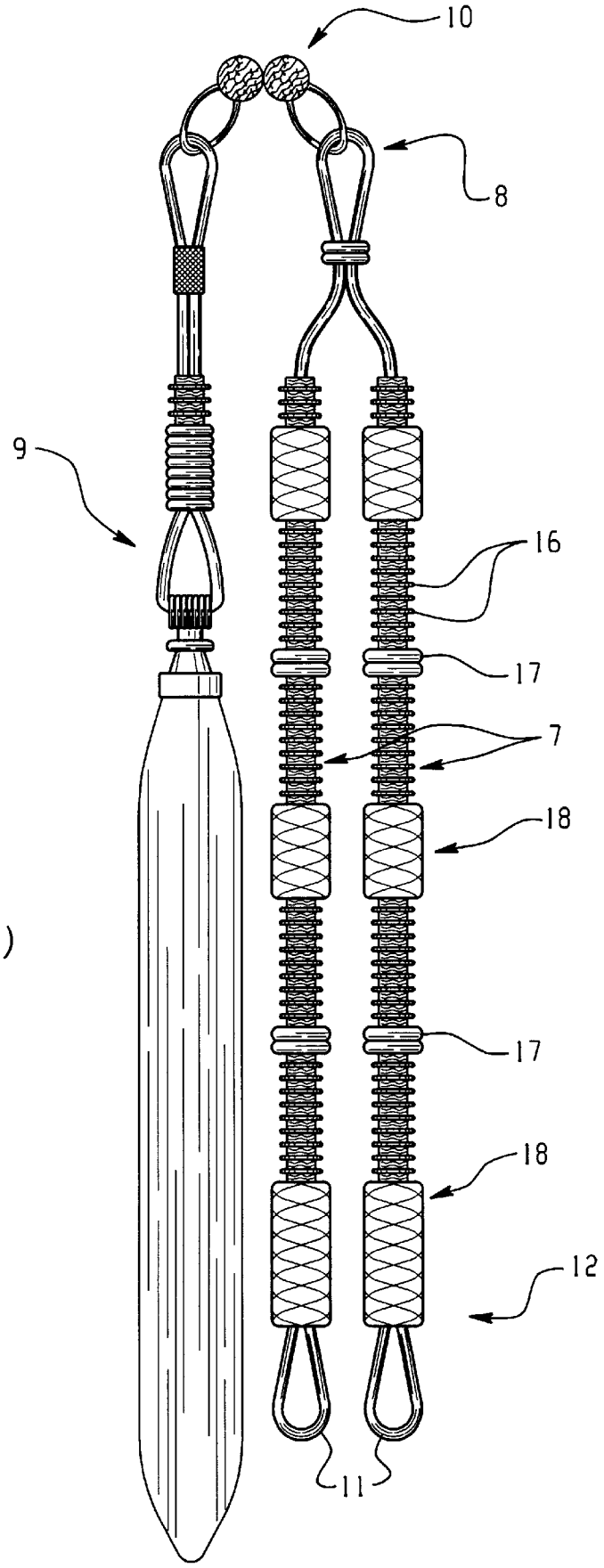
Fig. 2 (PRIOR ART)
FIG. 2 is a schematic illustration (not to scale) of a conventional braided romal rein.
Figure 4:
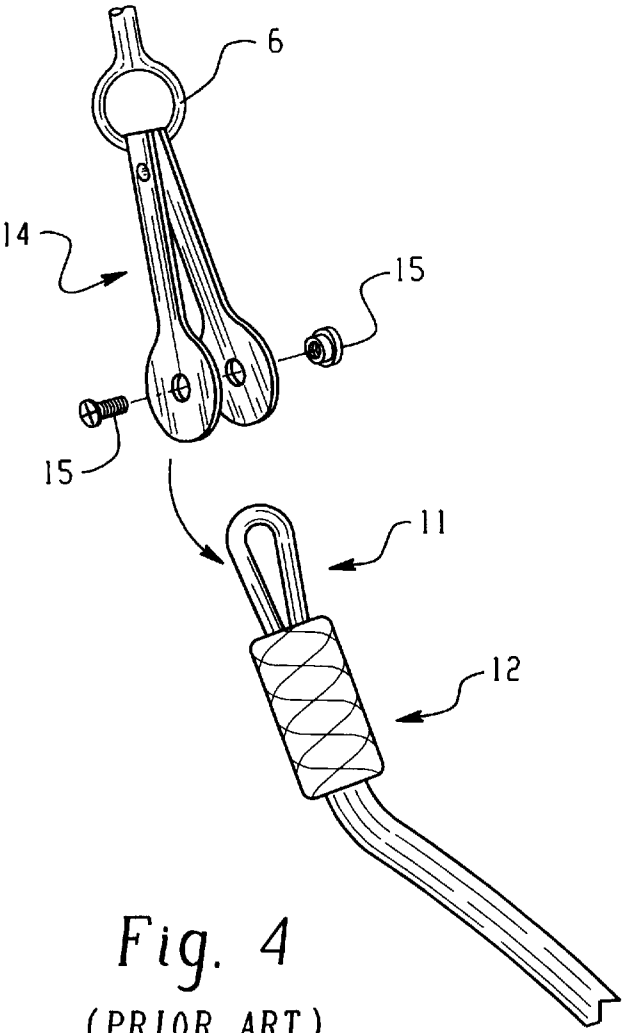
Fig. 4 (PRIOR ART)
FIG. 4 is a schematic illustration of a prior art connector for connecting a conventional braided romal rein to a bit.
Figure 3:
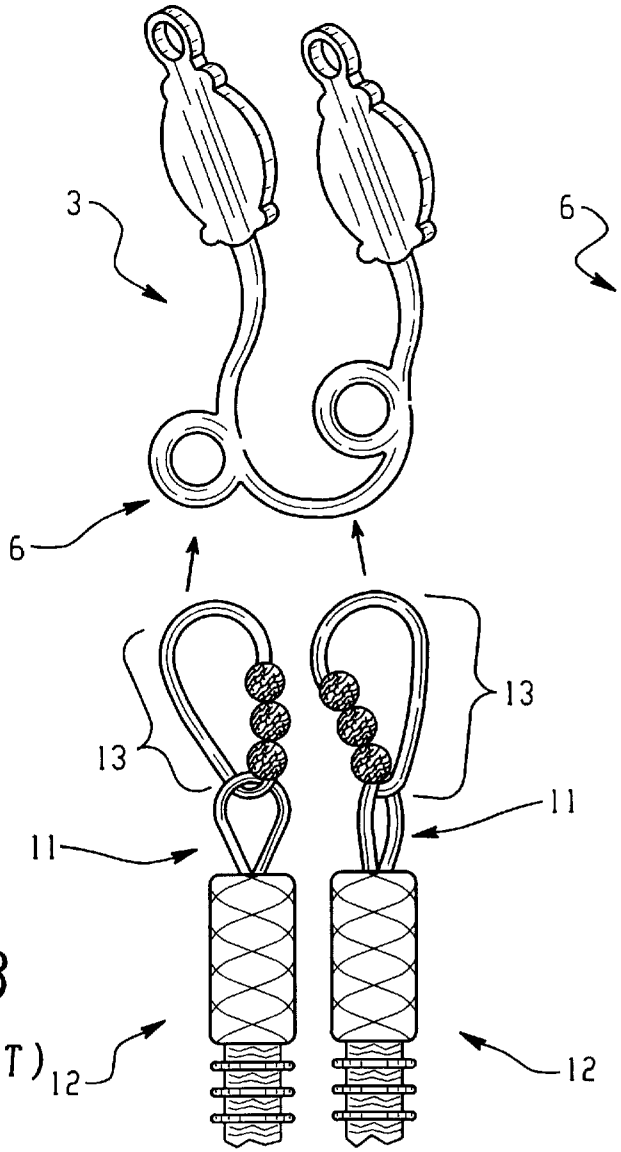
Fig. 3 (PRIOR ART)
FIG. 3 is a schematic illustration of prior art connectors for attachment of conventional braided romal reins to a bit.
Figure 5:
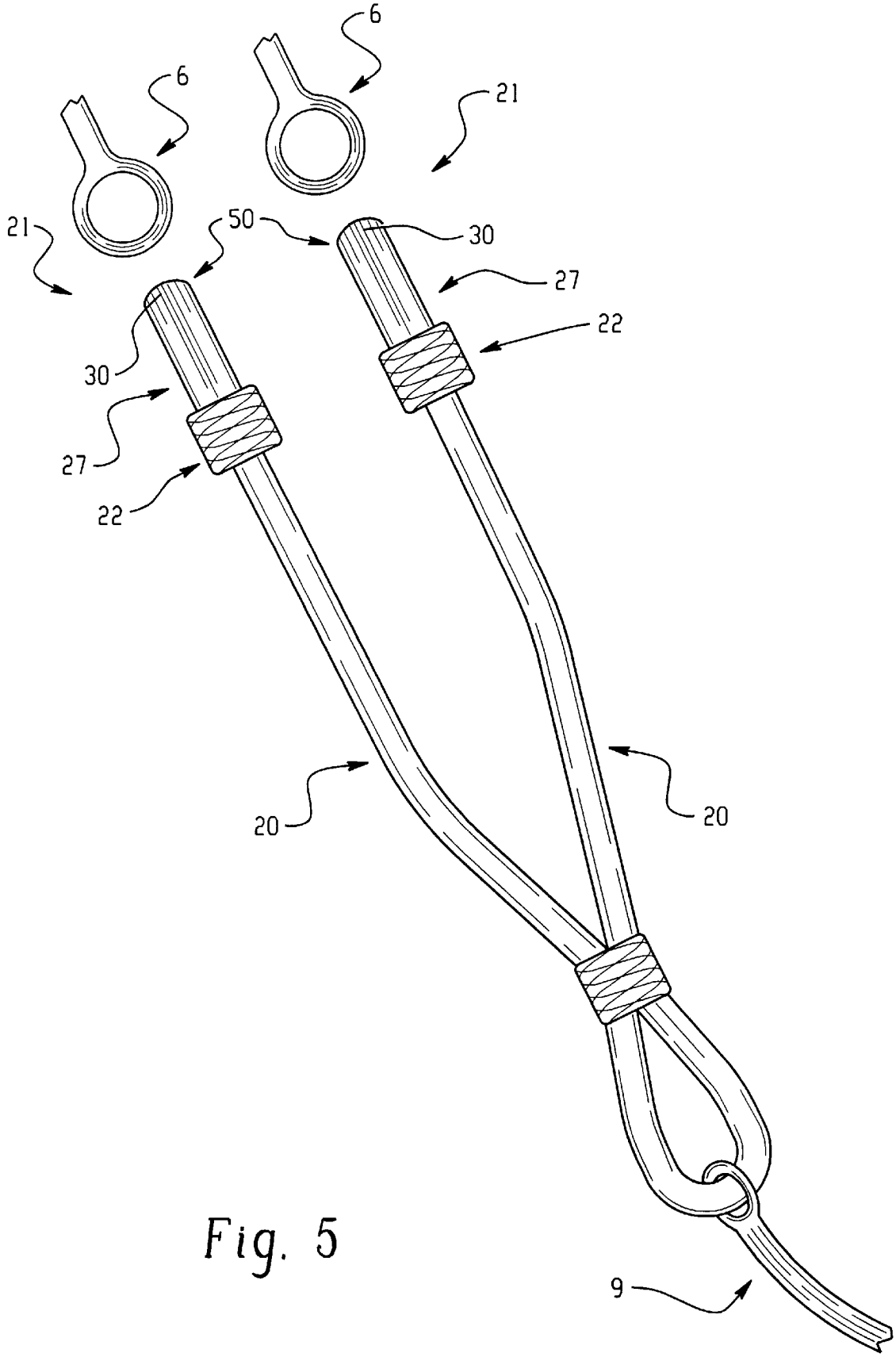
FIG. 5 is a schematic illustration of a romal rein of the invention having an integral connector portion of a rigid member for direct attachment of the rein to the bit.

A romal rein of the invention is schematically illustrated in FIG. 5. A length of rein 20 terminates in two bit ends 21, each of which comprises a flexible member 22 and a rigid member 27. The rigid member 27 has a first end (not shown) that extends into and is in tight contact with the interior of the flexible member 22 such that the rigid member 27 is firmly bound by the flexible member and is integral with the rein in a continuous construction. The rigid member 27 has a second end 30 that has a connector portion 50 for attachment to one of two end rings 6 of a bit (not shown). Because traditional romal reins are made of leather, it is preferred that the elements of the rein of the invention, including the rigid member and/or the flexible member, also employ leather. However, imitation leathers (e.g., plastics) that fulfill the criteria for these elements as described herein, may also be used in the invention.

In each of the preferred embodiments described below, the rigid member comprises at least three layers, i.e., two thin, lightweight layers of leather (e.g., about 1/16 inch thickness, preferably 4 oz. leather) and one or more thin (e.g., 1/16 inch thickness or less) reinforcing layers of material(s), such as plastic coated cotton webbing, vinyl coated nylon material, and the like. The layers are secured to each other by sewing, glueing, or other means of attachment known to those skilled in the art. The reinforcing layer is the major source of the strength and stiffness of the rigid member which, as defined above, has a strength and stiffness that is approximately equivalent to the strength and stiffness of an 8 ounce (oz.) piece of leather normally used in strap goods, such as reins and bridles. In several of the preferred embodiments, the layers of the rigid member are longitudinally separated either at the connecting portion for attachment to the end ring of the bit, or for forming a sandwich around the end of the core of the rein.

Other, less preferred embodiments of the invention are also described below wherein the rigid member comprises two thicker, heavier leather layers, without a reinforcing layer, that provide the required strength and stiffness.

Because reins are manufactured in a wide variety of lengths and thicknesses, the length and width of the rigid members are variable and may be determined for each kind of rein according to aesthetic and other criteria used by those skilled in the art.

Figure 6C:
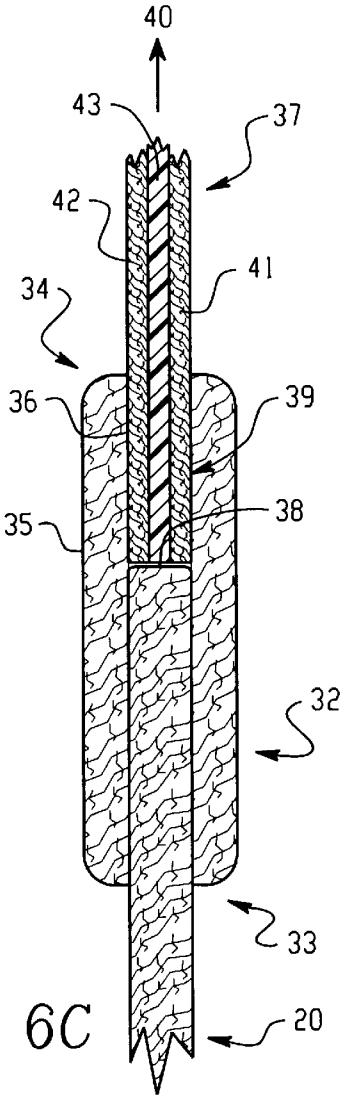
FIGS. 6A, 6B and 6C are schematic cross-sectional illustrations of preferred embodiments for securing the rigid member (comprising two thin leather layers and at least one reinforcing layer) and the end of the core of the rein within a flexible member.
Figure 6B:
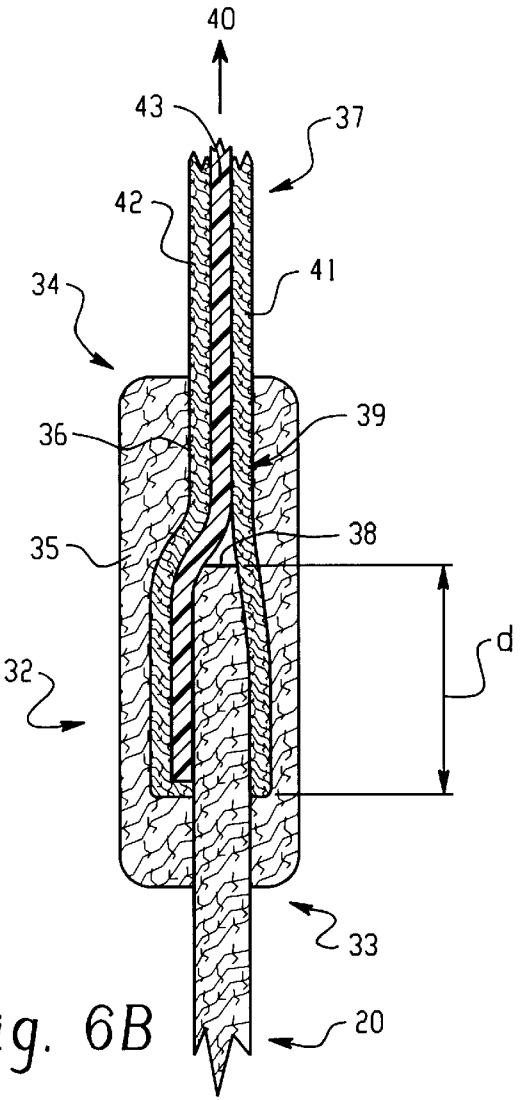
Figure 6A:
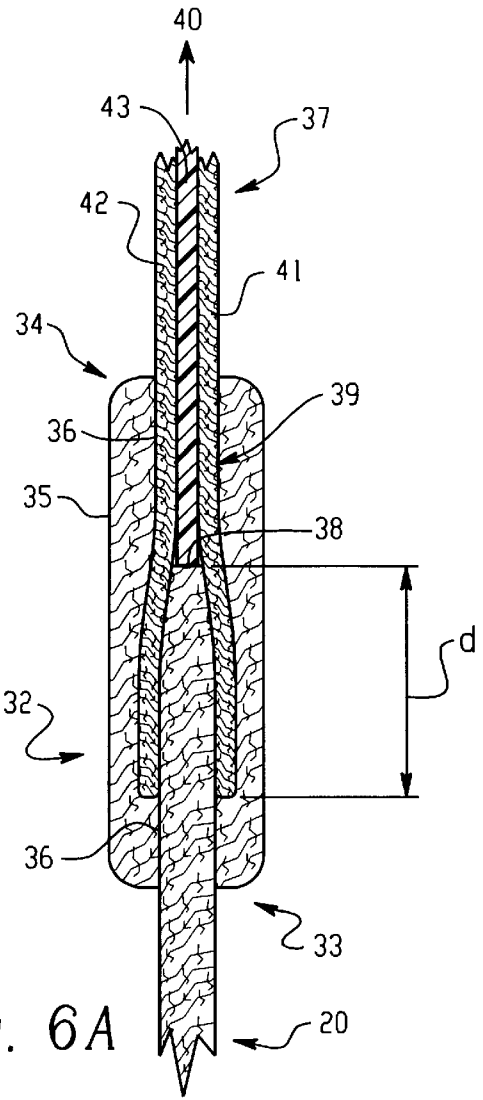

Several preferred embodiments of the construction of the bit end of the rein are illustrated in FIGS. 6A, 6B, and 6C. In each of the embodiments, the flexible member 32 has a first end 33 and a second end 34 and an outer wall 35 that defines a flexible tubular interior 36. A length of rein 20 has a core end 38 that extends into the first end 33 of the flexible member 32 and is in tight contact with the flexible tubular interior 36. A rigid member 37, having a first end 39 and a second end 40, is positioned at the second end 34 of the flexible member 32. The second end 40 of the rigid member 37 extends outwardly from the second end 34 of the flexible member 32 and has a connector portion (not shown in these figures) for attachment to end ring of a bit (located beyond the arrow). The first end 39 of the rigid member 37 extends into and is in tight contact with the flexible tubular interior 36 of the flexible member 32.

By definition above, the flexible member comprises an outer "wall" that defines the flexible tubular interior that tightly encloses and secures the core and rigid member ends. For example, such a construction could be formed by tightly binding a flexible cord (e.g., cotton, plastic, and the like) or thin, lightweight strands of leather (e.g., 1 oz. to 2 oz. leather) around the core and rigid member ends or, more preferably, by tightly braiding a flexible cord or thin strands of leather around the ends. An example of a flexible member is a terminal braided leather barrel of a conventional braided leather romal rein.

In preferred embodiments of the invention, illustrated in FIGS. 6A and 6B, the rigid member 37 comprises at least three attached layers, i.e., two thin outer layers of leather 41, 42 and one or more inner reinforcing layers 43. In this embodiment, the two thin layers of leather 41, 42 are preferably approximately equal in thickness, and are preferably pieces of about 4 oz. leather. Leather weights and their corresponding thicknesses are known to the skilled artisan. For example, a piece of 4 oz. leather is about 1/16 inch thick. Leathers used for strap goods, such as split reins and bridles, are typically 6 oz. to 8 oz. leathers, having a thickness of about 1/4 inch to about 3/8 inch. The thick leather used for saddles is typically 10 oz. to 14 oz.; whereas thin, flexible leathers used for laces or for braiding are typically 1 oz. to 2 oz. leathers.

In the preferred embodiments, the inner reinforcing layer (s) 43 is the major component for adding strength and stiffness to the rigid member, such that the combination of the three or more layers has a strength and stiffness approximately equivalent to the strength and stiffness of an 8 oz. piece of leather. There are many known types of materials that can provide the required strength and stiffness including thin, rigid thermoplastic and thermoset plastics, strong reinforcing nylon or cotton webbing, plastic coated webbing material, and the like, or combinations of these. A suitable reinforcing material for use in the invention is a heavy nylon webbing coated with vinyl, with the name "Biothane", manufactured by BioPlastics Company, Inc., North Ridgeville, Ohio. The use of one layer of Biothane with two 4 oz. strips of leather is sufficient to provide the desired strength and stiffness. One layer of Biothane is approximately 1/16 inch thick.

The thickness of the reinforcing layer required to provide the requisite strength and stiffness to the rigid member depends on the inherent strength and stiffness of the selected reinforcing material. Several layers of the reinforcing material may be required. Thus, the thickness of the resulting rigid member may vary from about 3/16 inch or less, to about 1/2 inch or more. As will become apparent from the embodiments of the invention described below, the thickness of the rigid member will determine which of the embodiments may be employed. Preferably, the rigid member is as thin as possible.

In the embodiment illustrated in FIG. 6A, the reinforcing layer(s) 43 extends within the rigid member 37 to a point at or near the junction with the core end 38 of the length of rein 20. The two outer layers 41, 42 of the rigid member 37 extend beyond the end of the reinforcing layer 43 and the core end 38 and sandwich the length of the rein for a variable distance "d" beyond the core end 38. The distance "d" can be determined by one skilled in the art according to the attachment means illustrated in FIG. 7, wherein the layers of the rigid member can be stitched and/or glued, bound, or otherwise attached to the core, thus securing the rigid member directly to the core of the rein.

Figure 7:
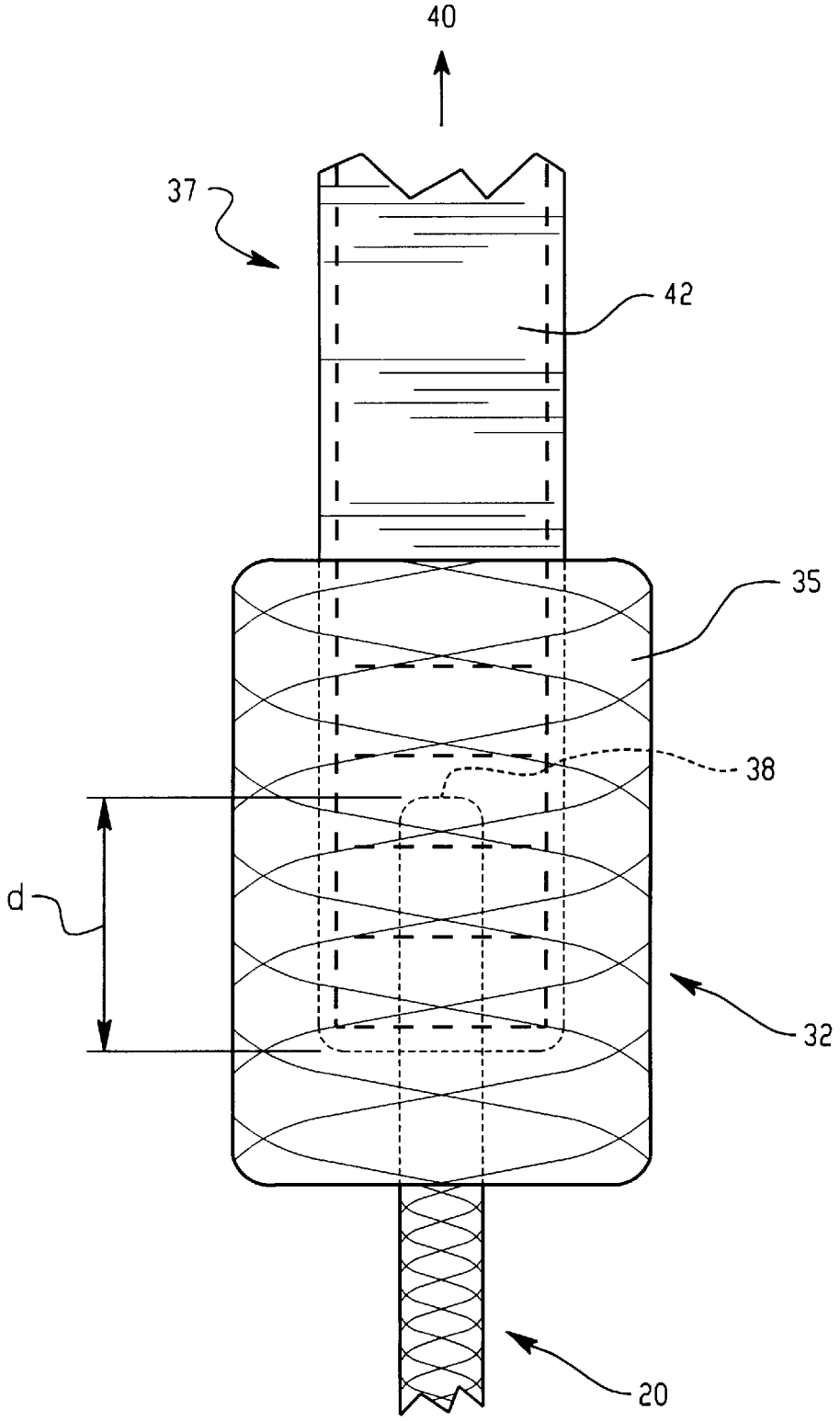
FIG. 7 is a schematic illustration of an embodiment for securing the end of the core of the rein within a sandwich formed by layers of the rigid member.

In the embodiment illustrated in FIG. 6B, the reinforcing layer(s) 43 remains associated with at least one of the two outer layers 41, 42 of the rigid member 37, and extend(s) in conjunction with the outer layer to participate in the sandwich of the length of the rein for the distance "d". The means of attachment to the core may also be as illustrated in FIG. 7.

In the embodiment illustrated in FIG. 6C, the end of the rigid member including the two outer layers 41, 42 and the reinforcing layer 43 do not extend beyond the end of the core of the rein. Instead, the rigid member end and the core end each extend into and are in tight contact with the tubular interior of the flexible member for a distance sufficient to secure the length of rein within the interior of the flexible member. The distance is determined by such variables as the diameter and flexibility of the core end, the thickness and rigidity of the layers of the rigid member, the tightness of the binding that forms the outer wall of the flexible member and defines the flexible tubular interior, the length and thickness of the outer wall of the flexible member, and the like.

Figure 8C:
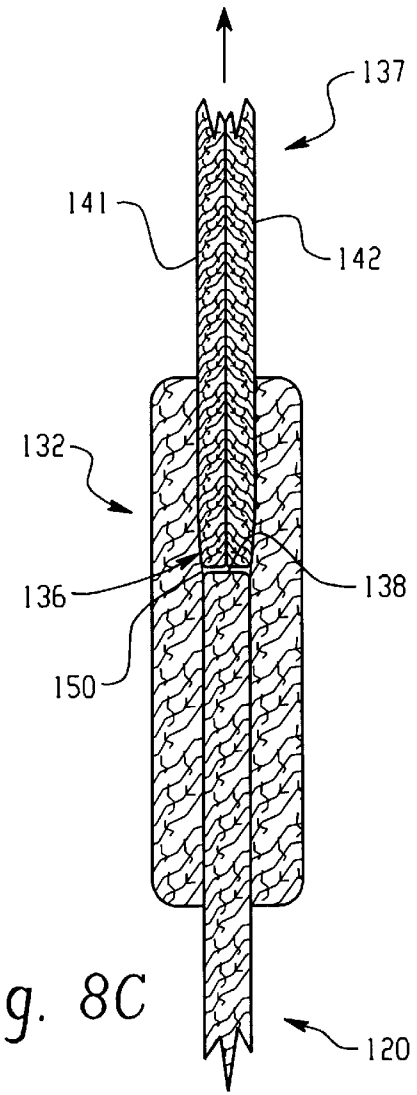
FIGS. 8A, 8B and 8C are schematic cross-sectional illustrations of another embodiment of the rigid member (comprising two leather layers) and for securing the rigid member and core of the rein to each other within the flexible member.
Figure 8B:
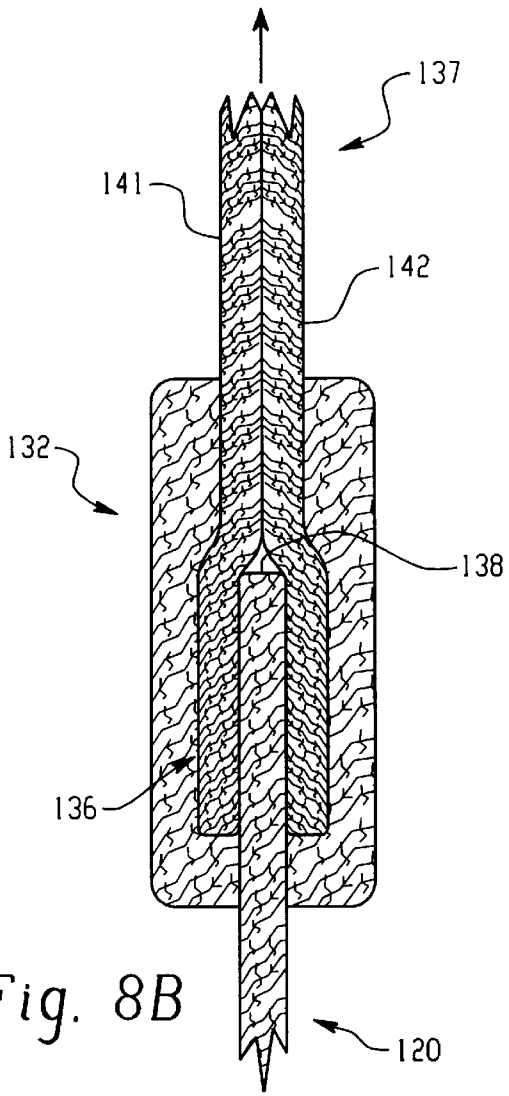
Figure 8A:
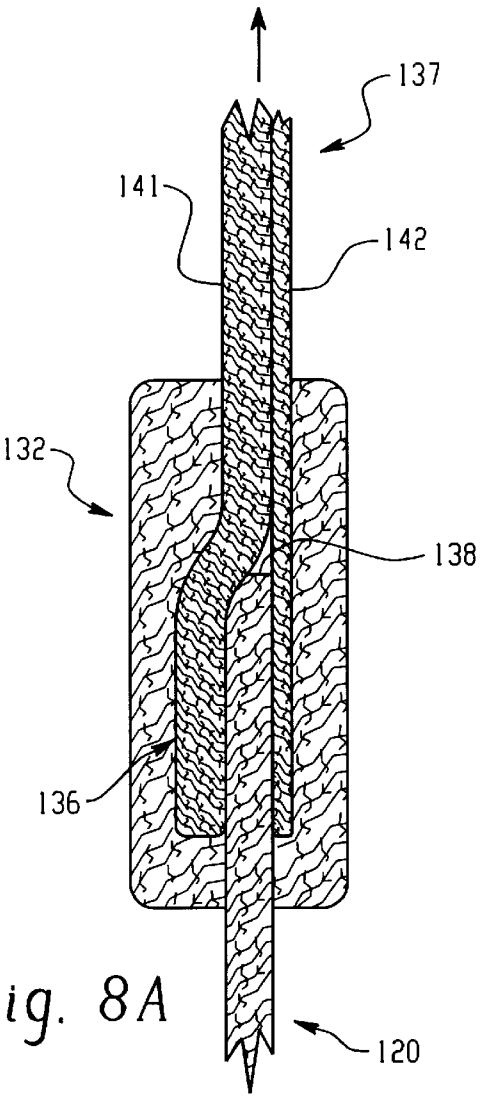

FIG. 8A, 8B and 8C illustrate less preferred embodiments of the rigid member that do not employ a reinforcing layer. Instead, the rigid member 137 in these embodiments comprises two or more layers of leather 141, 142, which together provide the required stiffness and strength. For example, one layer may be 8 oz. leather and the other layer 2 oz. leather (e.g., FIG. 8A); both layers may be 6 oz. leather or 8 oz. leather, or combinations of these, or the like (e.g., FIGS. 8B and 8C). The layers may extend to form a sandwich around the core end 138 of the length of the rein 120 within the flexible member 132, as illustrated in FIGS. 8A and 8B and be secured to the core end as illustrated in FIG. 7. Alternatively, the end of the rigid member may terminate at or near the core end 138 of the rein, as illustrated in FIG. 8C, and the core end 138 and the end of the rigid member 137 extend into the flexible tubular interior 136 of the flexible member 132 for a distance sufficient to secure them in the flexible member, the distance being variable as described above for the embodiment of FIG. 6C.

Although it is possible, in the embodiments illustrated in FIGS. 8A, 8B and 8C, to use two layers of heavier 6 oz. or 8 oz. leather (each layer typically ¼ inch to ⅜ inch thick), without a reinforcing layer, the resulting sandwich around the core of the rein is 2 to 3 times larger than that of the preferred embodiment of the invention, and the resulting flexible member 132 that encloses the sandwich may be much larger than that of the preferred embodiment. Thus, this embodiment of the invention is less preferred if the larger flexible member is aesthetically undesirable.

Embodiments of the second end and connector portion of the rigid member are illustrated in FIGS. 9 through 12. In each of these embodiments, the preferred rigid member comprises at least three layers, including the reinforcing layer, described above.

Figure 9A:
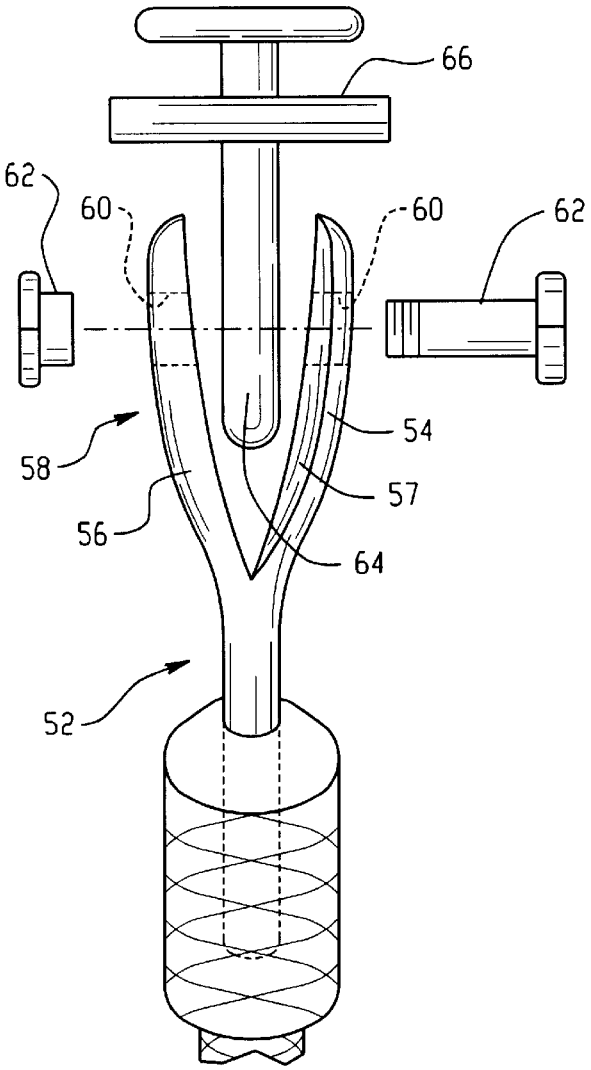
FIGS. 9A, 9B and 9C are schematic illustrations of a preferred embodiment having a sandwich configuration for connecting the preferred rigid member of the rein to the bit. This embodiment may also be used when the rigid member comprises two leather layers.
Figure 9B:
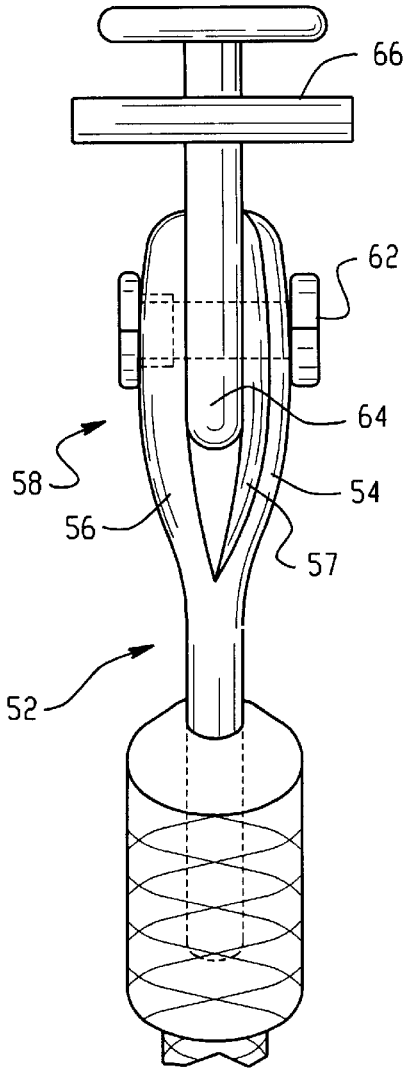

In a preferred embodiment of the connector portion of the rigid member illustrated in FIGS. 9A and 9B, a tight connection is provided between the connector and the end ring of the bit. In this embodiment, the rigid member 52 comprises at least three layers, i.e., two thin layers of leather 54, 56, and at least one reinforcing layer 57, as described above in FIGS. 6A, 6B and 6C. At the connector portion 58 of the rigid member 52, the two leather layers 54, 56 are longitudinally separated from each other. The reinforcing layer 57 remains attached to one of the leather layers. (If more than one reinforcing layer is employed, it may be remain attached to either one of the leather layers). Each of the separated layers 54/57 and 56 has an opening 60 therethrough for passage of a fastener 62, as illustrated for layer 54/57 in FIG. 9C. The fastener may be as simple as a cord (not shown), such as a leather cord, for tying the separated layers to the end ring. However, the fastener 62 is preferably a bolt arrangement, such as one having interlocking male and female portions for securing the separated layers 54/57 and 56 to the end ring 64 of the bit 66, such that the end ring 64 is sandwiched between the separated layers 54/57 and 56 and the bolt passes through the end ring 64. Such a bolt arrangement may be a typical nut and bolt. However, a preferred fastener for this embodiment of the invention is a chicago screw. When the male and female ends of the fastener are joined, the two layers of the rigid member form a tight connection with the end ring of the bit (FIG. 9B).

Figure 9C:
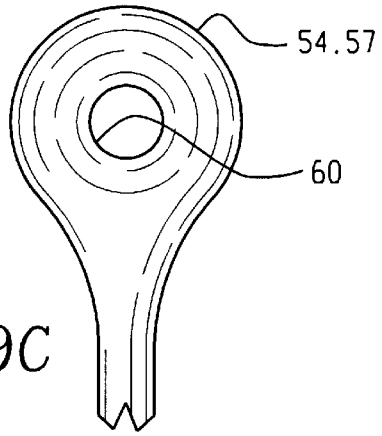
Figure 10C:
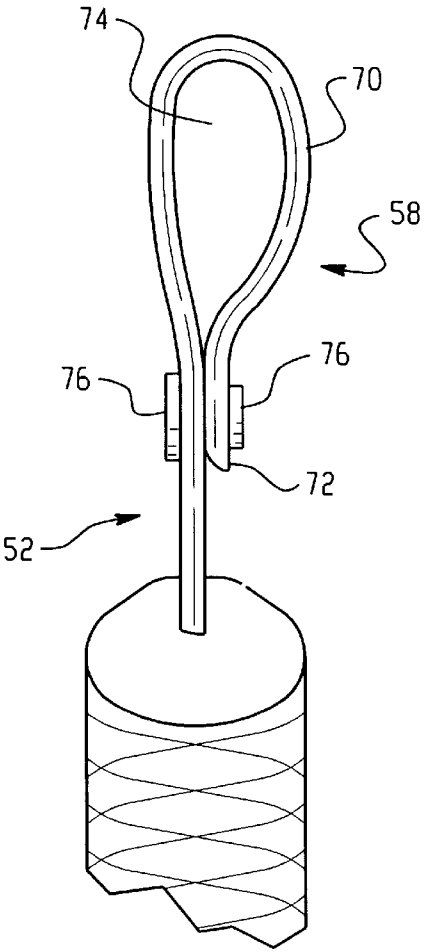
FIGS. 10A, 10B and 10C are schematic illustrations of another embodiment for connecting the preferred rigid member of the rein to the bit.
Figure 10B:
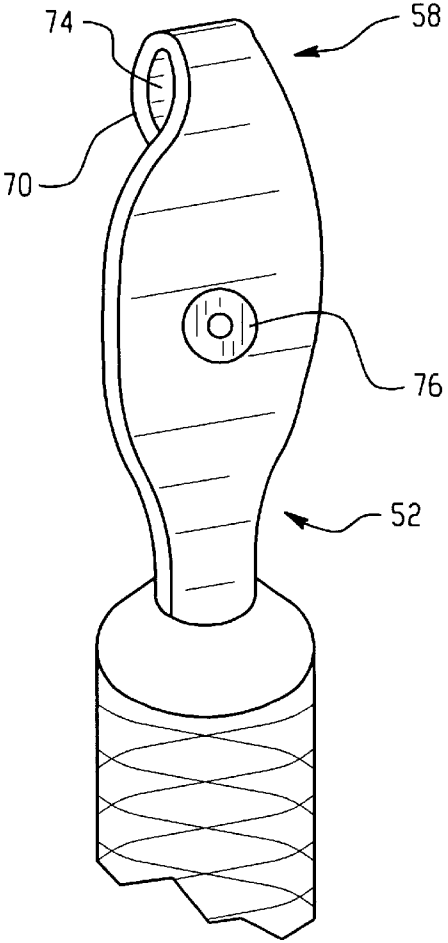
Figure 10A:
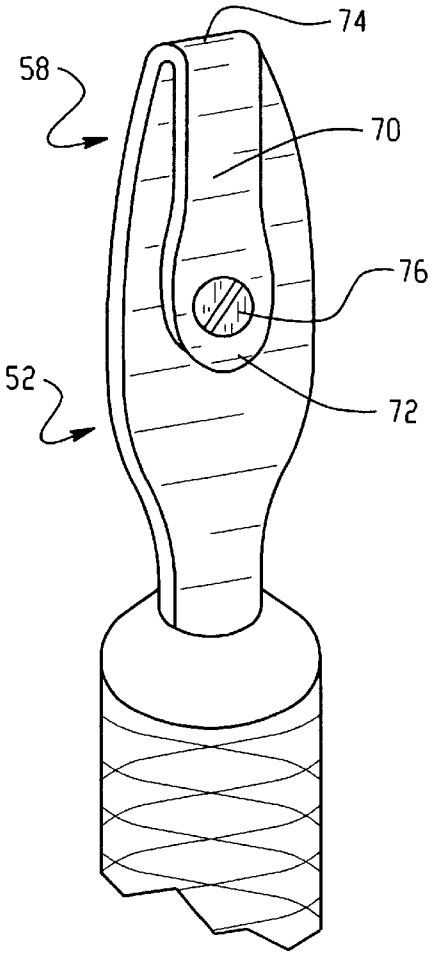

The embodiment of the connector portion illustrated in FIGS. 9A, 9B and 9C is also suitable in embodiments of the invention employing a rigid member that comprises two layers of leather without a reinforcing layer, such as the embodiments illustrated in FIGS. 8A, 8B and 8C.

FIGS. 10A, 10B, 10C and 11 illustrate other embodiments of the connector portion 58 of the rigid member 52. In each of these embodiments, the rigid member comprises a strap 70 having a strap end 72 for passage through the end ring of a bit (not shown) to form a loop 74. The strap end 72 is then fastenable to the rigid member by a fastener. Many different types of fasteners are suitable for use to fasten the strap end, and such fasteners are known to those skilled in the art. The illustrated fasteners are a chicago screw 76 (FIGS. 10A, 10B, 10C), a buckle (FIG. 11) or any other fastener known to those skilled in the art, such as a snap fastener (not shown).

Figure 12B:
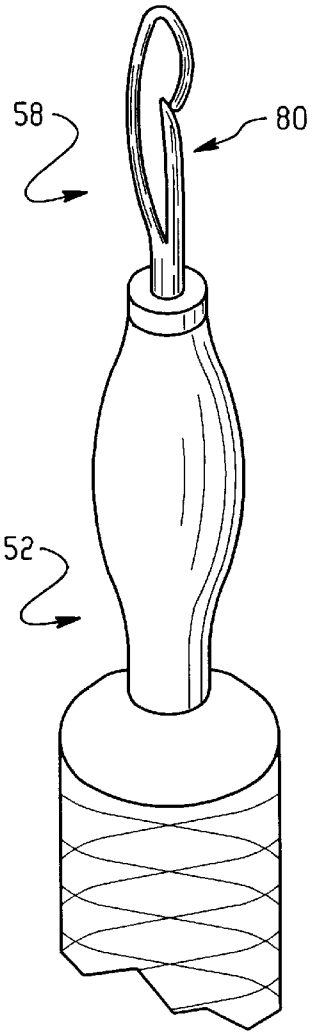
FIGS. 12A and 12B are a schematic illustrations of another embodiment for connecting the rigid member of the rein to the bit, which may be employed with either the preferred rigid member, or the rigid member comprising two leather layers.
Figure 12A:
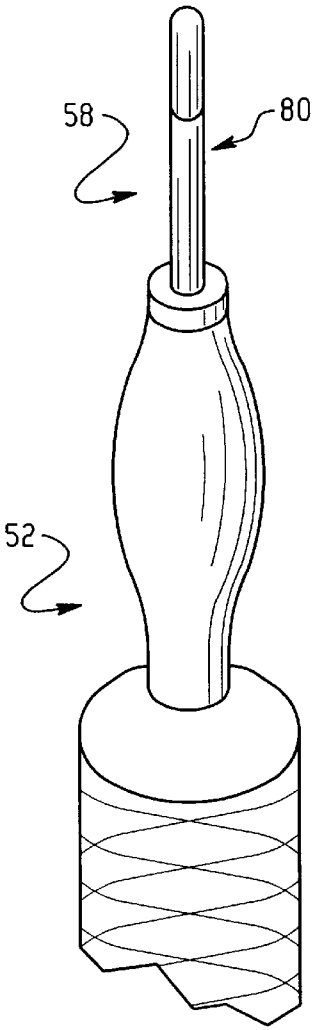
Figure 11:
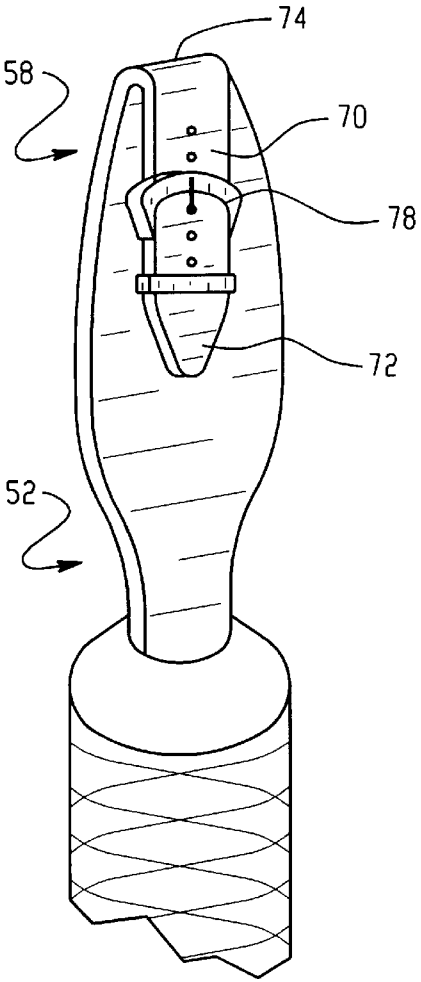
FIG. 11 is a schematic illustration of another embodiment for connecting the preferred rigid member of the rein to the bit.

In another embodiment of the connector portion 58 of the rigid member 52, illustrated in FIGS. 12A and 12B, the connector portion comprises a rigid snap end fastener 80 integrally attached to and extending from the rigid member, for snapping onto the ring of the bit (not shown).

Figure 13C:
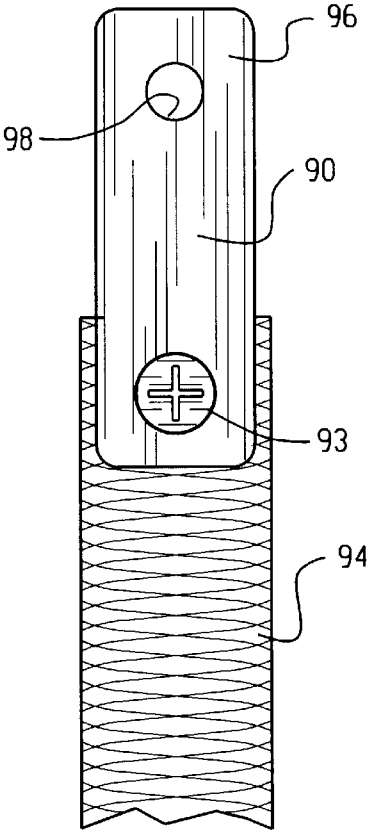
FIGS. 13A, 13B and 13C are schematic illustrations of an embodiment of a flat rein having rigid members for connecting the rein to the bit in a sandwich configuration.
Figure 13B:
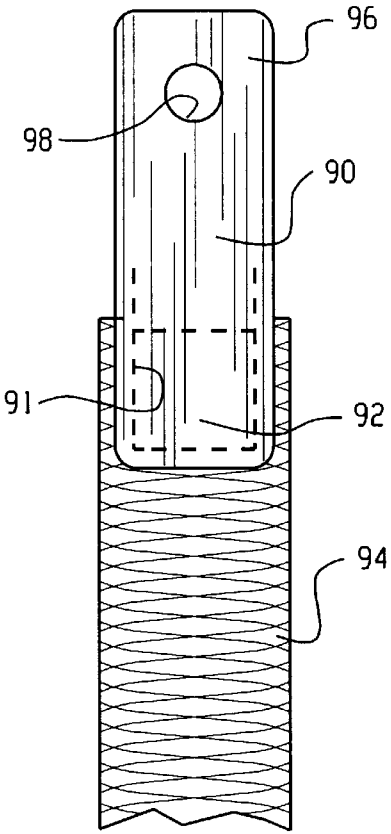
Figure 13A:
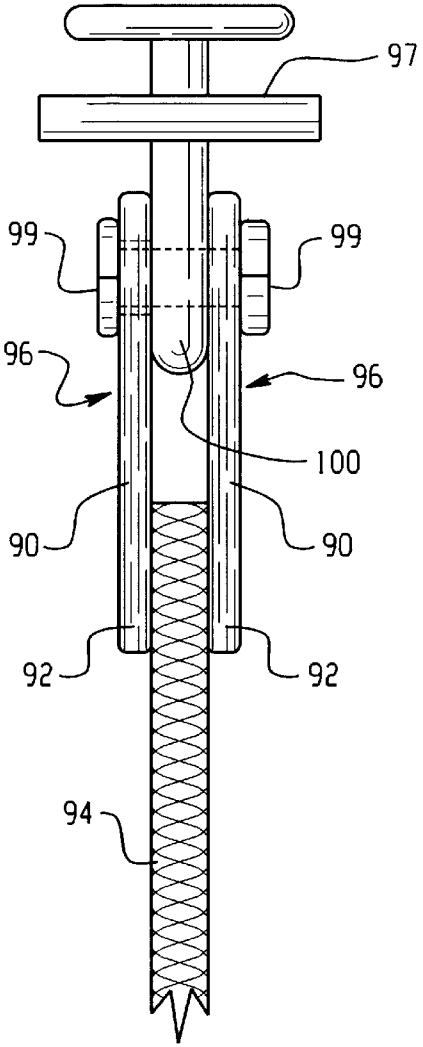

In another embodiment of the invention, flat split or romal reins are provided by which the bit end of the rein may be attached to the flat rein without the presence of a flexible member, as illustrated in FIGS. 13A, 13B and 13C. A tight connection between the end ring 100 of the bit 97 and the rein is also provided. In this embodiment, each of at least two rigid members 90 has an end 92 integrally secured to the length of flat rein 94 and a connector end 96 extending from the length of rein 94. Each connector end 96 has an opening 98 therethrough for passage of a fastener 99. For connecting the rein to the end ring 100 of the bit 97, the end ring is sandwiched between the two rigid members and secured by the fastener 99 that passes through the end ring and each of the rigid members. The fastener may be a cord for tying the rigid members and the end ring together, but preferably is a bolt arrangement, such as that described above, which may be a nut and bolt, but preferably is a chicago screw, wherein the bolt passes through each of the layers and the end ring of the bit. As illustrated in FIGS. 13B and 13C, the rigid members may be connected to the flat rein by stitching 91 and/or gluing (not shown) and/or tying, or by a fastener 93 known to those skilled in the art, such as a snap fastener or a chicago screw, or the like.

Figure 14:
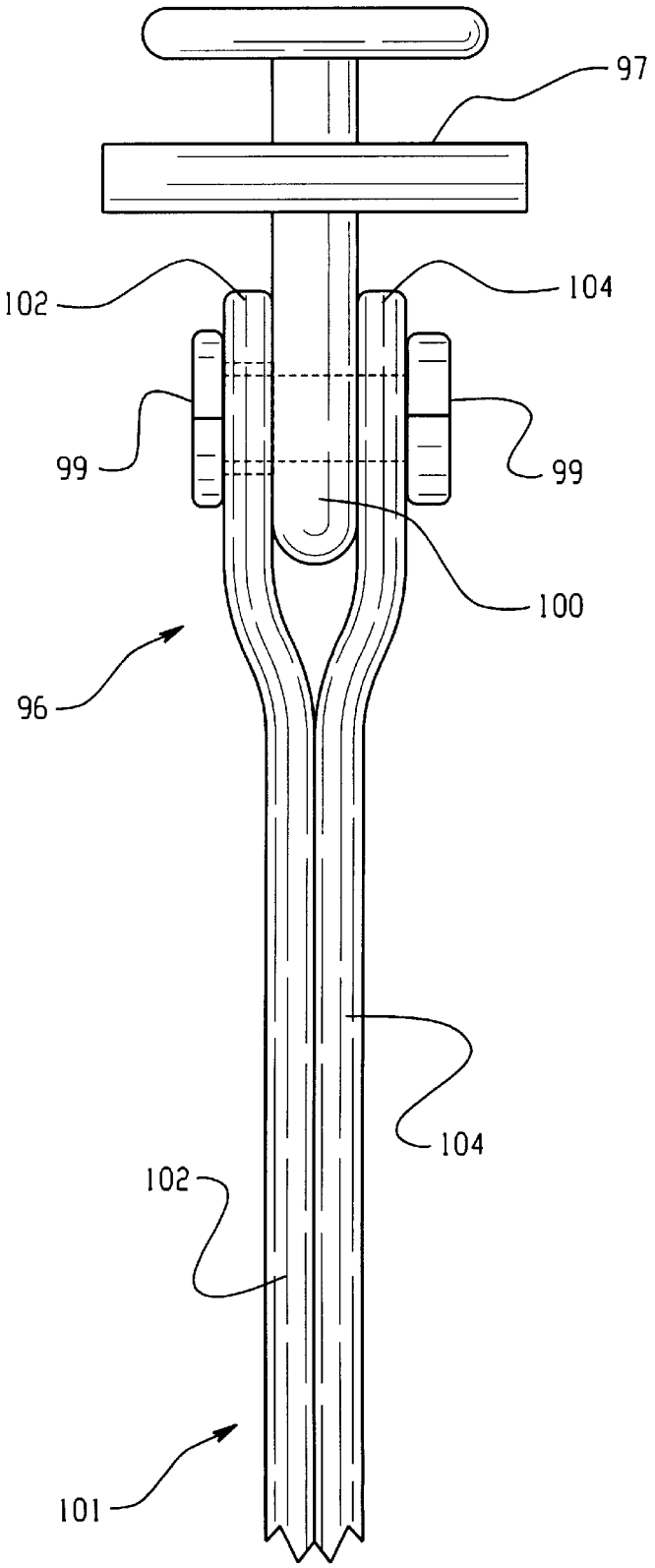
FIG. 14 is a schematic illustration of an embodiment of a flat rein having two or more layers, in which at least two layers are separated at the bit end for connecting the rein to the bit in a sandwich configuration.

In another embodiment of the invention illustrated in FIG. 14, a flat rein 101 is provided which comprises two layers 102 and 104. At the connector end 96 of the rein, the two layers are longitudinally separated from each other to form two separated layers 102 and 104, each of which has an opening therethrough for passage of a fastener 99, the opening and the fastener being similar to those illustrated in FIG. 13B and 13C. The fastener is preferably a bolt arrangement described above, which may be a nut and bolt, but preferably is a chicago screw. For connecting the rein to the end ring 100 of the bit 97, the end ring is sandwiched between the two rigid members and the bolt passes through the end ring and each of the rigid members. Attentively, the fastener may be a cord for tying the two separated layers to the end ring.

While the invention has been described herein with reference to the preferred embodiments, it is to be understood that it is not intended to limit the invention to the specific forms disclosed. On the contrary, it is intended to cover all modifications and alternative forms falling within the spirit and scope of the invention.

I claim:

1. A rein, comprising:

a length of rein terminating in a bit end that comprises a rigid member having a connecting portion configured to directly connect the rein to an end ring of a bit, without the use of a separate connecting piece between the rein and the bit.

2. The rein of claim 1, wherein the rigid member comprises at least one reinforcing layer.

3. The rein of claim 2, wherein the at least one reinforcing layer comprises a selection from the group consisting of thermoplastic plastic, thermoset plastics, nylon webbing, cotton webbing, plastic coated nylon webbing, plastic coated cotton webbing, and combinations of these.

4. The rein of claim 3, wherein the at least one reinforcing layer comprises vinyl coated nylon webbing.

5. The rein of claim 2, wherein the rigid member further comprises at least one outer layer attached to the at least one reinforcing layer.

6. The rein of claim 5, wherein the at least one outer layer is leather.

7. The rein of claim 1, wherein the rigid member comprises at least two layers, and the connecting portion comprises said two layers longitudinally separated from each other to form two separated layers, each of the separated layers having an opening therethrough for passage of a fastener.

8. The rein of claim 7, further comprising a fastener.

9. The rein of claim 8, wherein the fastener comprises a bolt configured to secure the two separated layers to the end ring of the bit, wherein the end ring is sandwiched between the two separated layers and the bolt passes through the end ring.

10. The rein of claim 8, wherein the fastener is a chicago screw.

11. The rein of claim 1, wherein the connecting portion of the rigid member comprises a strap having a strap end for passage through the end ring of the bit to form a loop, wherein the strap end is fastenable to the rigid member by a fastener.

12. The rein of claim 11, wherein the fastener is selected from the group consisting of a chicago screw, a buckle, a cord, and a snap fastener.

13. The rein of claim 1, wherein the connecting portion of the rigid member comprises a rigid snap end fastener integrally attached to and extending from the connecting portion, wherein the snap end fastener is configured to snap onto the ring of the bit.

14. A braided romal rein, comprising:

a length of rein having a bit end that comprises (i) a flexible member having a first end and a second end and an outer wall defining a flexible tubular interior, wherein an end of the length of rein enters the flexible tubular interior at the first end of the flexible member and is in tight contact with and extends into the flexible tubular interior for a distance sufficient to secure the length of rein within the interior of the flexible member; and (ii) a rigid member positioned at the second end of the flexible member, the rigid member having a first end and a second end, wherein the first end of the rigid member is in tight contact with and extends into the tubular interior of the flexible member for a distance sufficient to secure the first end of the rigid member within the interior of the flexible member, wherein the second end of the rigid member extends outwardly from the second end of the flexible member and has a connector portion configured to be attachable to an end ring of a bit.

15. The rein of claim 14, wherein the rigid member comprises at least two layers and the first end of the rigid member comprises said at least two layers longitudinally separated from each other to form two separated layers, wherein the end of the length of rein is sandwiched by the separated layers and secured to the end of the rigid member.

16. A rein, comprising:

a length of rein terminating in a bit end, said bit end comprising a connector portion configured to be attachable to an end ring of a bit, wherein the connector portion comprises two rigid members, each of said members having an end integrally secured to the length of rein and another end extending from the length of rein, each member having an opening therethrough configured to accept passage of a fastener.

17. The rein of claim 16, wherein the fastener comprises a bolt configured to secure the two rigid members to the end ring of the bit, wherein the end ring is sandwiched between the two rigid members and said bolt passes through said end ring.

18. The rein of claim 16, wherein the fastener is a chicago screw.

* * * * *